US007786897B2

(12) United States Patent
Alves

(10) Patent No.: US 7,786,897 B2
(45) Date of Patent: Aug. 31, 2010

(54) HIGH OCCUPANCY VEHICLE (HOV) LANE ENFORCEMENT

(75) Inventor: James Francis Alves, San Diego, CA (US)

(73) Assignee: Jai Pulnix, Inc., San Jose, CA (US)

( * ) Notice: Subject to any disclaimer, the term of this patent is extended or adjusted under 35 U.S.C. 154(b) by 265 days.

(21) Appl. No.: 11/656,671

(22) Filed: Jan. 23, 2007

(65) Prior Publication Data

US 2008/0175438 A1 Jul. 24, 2008

(51) Int. Cl.
*G08G 1/017* (2006.01)

(52) U.S. Cl. ..... 340/937; 340/905; 340/917; 382/104; 382/105

(58) Field of Classification Search ..... 340/905, 340/917, 539.1, 906, 919, 928, 933, 936, 340/937; 701/200, 201, 207, 209; 382/105, 382/104

See application file for complete search history.

(56) References Cited

U.S. PATENT DOCUMENTS

| | | | | |
|---|---|---|---|---|
| 5,381,155 | A * | 1/1995 | Gerber | 342/104 |
| 5,850,191 | A * | 12/1998 | Yagi et al. | 340/928 |
| 6,970,102 | B2 * | 11/2005 | Ciolli | 340/933 |
| 7,068,185 | B2 * | 6/2006 | Kavner | 340/933 |
| 2005/0078297 | A1 * | 4/2005 | Doemens et al. | 356/5.04 |

OTHER PUBLICATIONS

John Billheimer, et al., "Use of Videotape in HOV Lane Surveillance and Enforcement", Mar. 1990, SYSTAN, Los Altos, California.
JAI-Pulnix, "Vehicle Image Capture (VIC) Computer" datasheet, San Jose, CA, Apr. 17, 2002.

* cited by examiner

*Primary Examiner*—Anh V La
(74) *Attorney, Agent, or Firm*—Thomas E. Schatzel

(57) ABSTRACT

An HOV enforcement system comprises roadside imaging units connected over a network to a central processing center. The roadside imaging units include Ethernet cameras with integrated vehicle detectors, night-time lighting, and image servers. The central processing center includes a central server with license plate reading and vehicle matching software, storage and databases, and review staff to issue bills and citations.

7 Claims, 2 Drawing Sheets

HIGH OCCUPANCY VEHICLE (HOV) LANE ENFORCEMENT

FIELD OF THE INVENTION

The present invention relates to high occupancy vehicle (HOV) lane enforcement, and more specifically to intelligent transportation systems (ITS) automation that can spot HOV compliance and signal law-enforcement officials when violations are detected.

BACKGROUND OF THE INVENTION

John W. Billheimer, et al., reported in Mar. 1990, USE OF VIDEOTAPE IN HOV LANE SURVEILLANCE AND ENFORCEMENT FINAL REPORT, that the enforcement of California's HOV lanes required substantial commitments of California Highway Patrol (CHP) personnel and equipment. Personnel costs for enforcing the state's ten mainline HOV lanes exceeded $400,000 in 1990. HOV lane enforcement has other costs as well. These include the risks of high-speed pursuit in lanes adjacent to stop-and-go traffic, and the deterioration of traffic flow when tickets are issued during peak commute periods. It was suggested that using video equipment to assist in HOV lane enforcement could reduce the requirements for patrol officers, increase citation rates, and minimize freeway disruption. Their investigation was designed to extend past studies of HOV lane enforcement by testing both the feasibility and accuracy of the use of video equipment in HOV lane surveillance.

The principal purposes of violation enforcement systems include catching and fining violators, and establishing a deterrent for future violations. Intense police enforcement can be prohibitively expensive and socially unacceptable. The costs of deploying and operating the enforcement system are traded off against the enforcement rate that yields an effective deterrence, e.g., acceptable limit on violator rate.

In order to deter violators, law enforcement must be able to collect fines from any vehicle, since any vehicle can be a violator. Fee collection requires a video-based billing system, and labor costs are the overriding cost driver of such systems. Cost-effective video enforcement requires a highly integrated system design. Many thousands of images cannot be processed by individuals without some kind of computerized assistance. So computers and video should be used to screen-out non-violations, and human operators can be assigned to verify violations in images flagged by the computer.

In general, video enforcement systems require 1) image capture, 2) violation detection, 3) vehicle identification, 4) owner identification, 5) bill issuance, 6) payment processing, 7) dispute resolution, 8) unpaid bills enforcement and collection, and 9) automatic system monitoring.

Using officers to enforce HOV lanes consumes a valuable resource. Not all occupants are readily visible, e.g., small children, adults laying down, or others not otherwise visible through the windows of the vehicle. Some vehicle windows can be hard to see through, especially at night, during rain/snow, in sun glare, or when tinted/metallized. Utilizing expensive multi-spectral cameras and processing techniques to detect human flesh inside vehicles and thereby thwart cheaters who would use dummies or mannequins to fool an automated system is not worth the added expense since people in heavy makeup or wearing masks would not be detected. Pulling over HOV violators is dangerous, disruptive, and time-consuming.

SUMMARY OF THE INVENTION

Briefly, an HOV enforcement system embodiment of the present invention comprises roadside imaging units connected to a processing unit that may be located at the roadside or at a central processing center. The roadside imaging units include Ethernet cameras with integrated vehicle detectors, night-time lighting, and image servers. The central processing center includes a central server with license plate reading and vehicle matching software, storage and databases, and personnel to issue bills or citations.

An advantage of the present invention is that violators can be automatically detected at the roadside without impeding traffic flow.

Another advantage of the present invention is that only images of potential violators need be sent from the roadside units to the personnel that will make the final determination to issue a bill or citation.

A further advantage of the present invention is that images are analyzed by computer to minimize labor costs.

A still further advantage of the present invention is human image reviewers are used to ensure reliability and accuracy of HOV violations.

These and other objects and advantages of the present invention will no doubt become obvious to those of ordinary skill in the art after having read the following detailed description of the preferred embodiment as illustrated in the drawing figures.

DETAILED DESCRIPTION OF THE EMBODIMENTS

Figure 1:
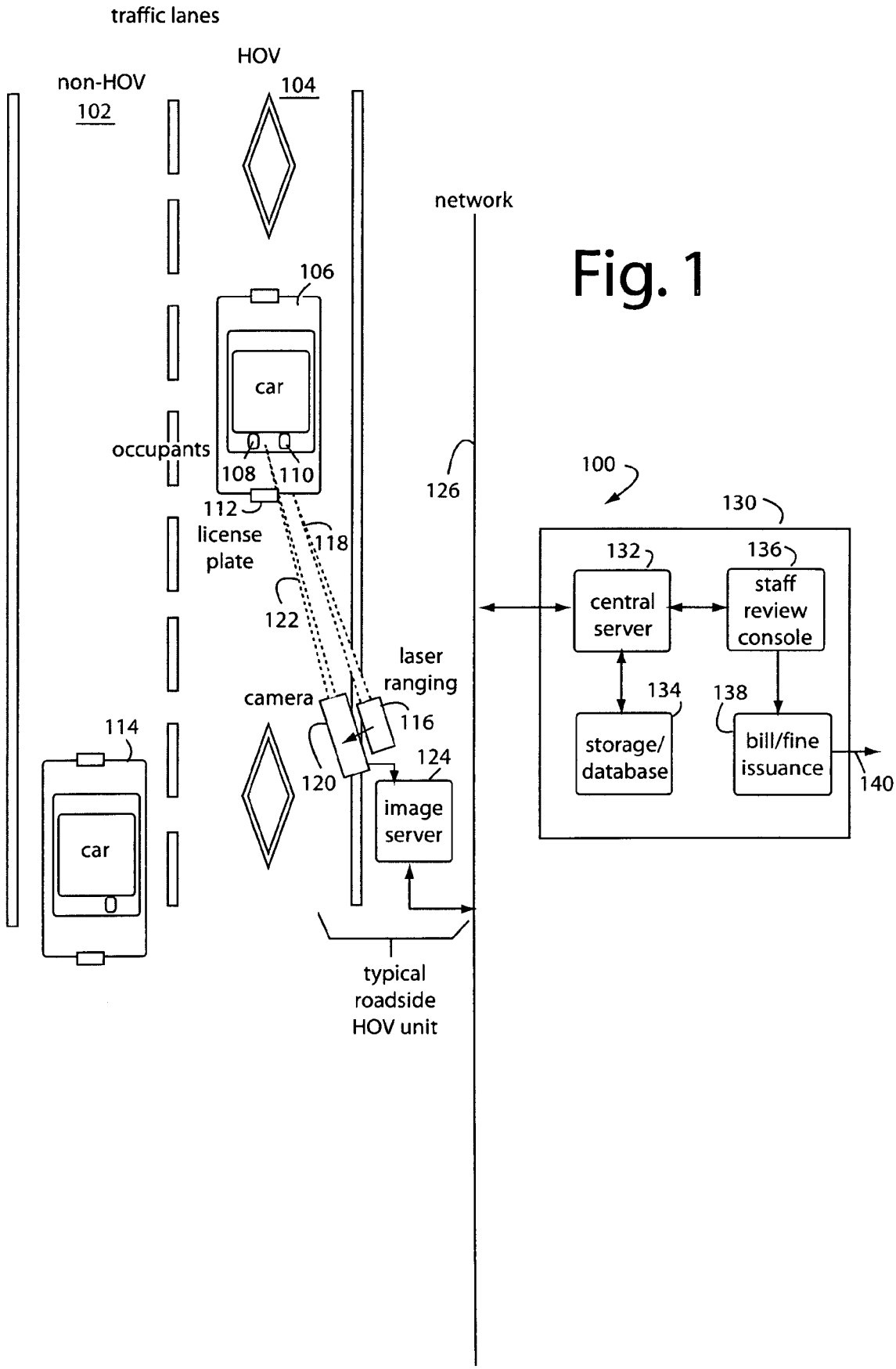
FIG. 1 is a functional block diagram of a HOV enforcement system embodiment of the present invention.

FIG. 1 represents an HOV enforcement system embodiment of the present invention, and is referred to herein by the general reference numeral 100. For example, a highway includes a non-HOV lane 102 and an HOV lane 104. Legal use of the HOV lane 104 requires a car 106 to have at least two occupants 108 and 110, and a front license plate 112. A car 114 is of no interest because it is not traveling in the HOV lane 104. A laser ranging device 116 sends a laser beam 118 that detects when a car is within range of an associated video camera 120. The camera is triggered to take its images at the appropriate times. An optical image 122 includes the faces of occupants 108 and 110, as viewed through the windshield, and a license plate 112. If any additional occupants are visible inside car 106, their images too will be captured and recorded by an image server 124. Advanced signal processing is used to account for rain water on the road or car windshield, night conditions, and adverse position-of-the-sun caused glare.

Camera 120 and other parts of system 100 are preferably implemented with JAI-Pulnix (San Jose, Calif.) traffic cameras and components. Suitable JAI-Pulnix commercial products include TM-1400 CCD camera, TM-9701TC traffic camera, TS-9720EN Ethernet CCD camera, Smart Light Sensor, Xenon Flash Illuminator, Video Image Capture (VIC)

subsystem, VIC computer, Video Image Processor (VIP), Vehicle Imaging System (VIS), Vehicle Fingerprinting, etc.

Static and real-time violation data is associated with images, and a built-in FPGA and PowerPC semiconductor devices provide JPEG compression, plate-area extraction, and run JAI-Pulnix VEHICLE-FINGERPRINTING™ software. An "invisible flash" unit is used with the camera comprising a long-life xenon bulb and filters to remove the visible spectrum. Such allows imaging of non-retro and retro-reflective license plates. Image matching is used that compares image patterns, rather than trying to do symbolic recognition. This allows the vehicle itself to become a part of the whole image matching. Vehicle fingerprinting technology converts an image of a vehicle to a unique and repeatable pattern called a "visual fingerprint". The visual fingerprint is a condensed image of about one kilobyte, not a text-based plate-read description of the vehicle. Plate area and larger vehicle features are represented in the fingerprint. Vehicle fingerprints can be compared against a list of candidate fingerprints to identify a previously seen vehicle. Plate status data is entered into a computer graphics program. Such program uses a database of plate-template blanks and character fonts to create an artificial plate image. This is then processed into a vehicle fingerprint for subsequent matching. After a match is found, a real fingerprint can be generated from the vehicle image.

VEHICLE-FINGERPRINTING will correctly match any plate style or type, in or out-of of-state. It does not need to be re-programmed or re-trained if new plate styles are issued. It is not nullified by trailer hitches, plate frames, etc., because it uses more information than just the license plate characters. It can tell if a high mileage vehicle (HMV) license plate is on a non-HMV. The technology was proven in various Netherlands speed enforcement projects, the Dulles Greenway toll road in Virginia, and parking systems in Japan. The privacy of the vehicle owners is preserved by not reading the plates. VEHICLE-FINGERPRINTING works whether the vehicle has a computer readable number plate or not.

The image server 124 processes video taken of each car passing in the HOV lane 104 to determine if a violation has occurred. HOV lanes can be restricted to a minimum of two occupants if traveling during rush hours, e.g., 7-9 AM or 4-6 PM. Vehicle registration information is extracted from the video image of license plate 112 taken by camera 120. Or at a minimum, the image is processed to extract the license plate number and state of issuance. If it appears a prima facia violation has occurred, the image and associated data, e.g., time, date, place, are forwarded over a network 126 to a central processing center 130.

The central processing center 130 includes a central HOV-enforcement network server 132. It consults a storage/database 134 to obtain vehicle registration information, and stores the image and associated time, date, place data sent in from many roadside HOV-enforcement units. Information from the storage/database 134 will be attached to the images forwarded from the roadside HOV-enforcement units. Some "violators" may be preliminarily excused as having paid a special HOV-usage fee. A final decision of violation will be made by staff at a review console 136. Quality-control checks can be made by human operators to see if the automated violation analysis was correct, and that the vehicle operators can be recognized from the photos. A bill/fine issuer 138 will then output a bill-citation 140 for mailing to the vehicles' registered addresses.

Cameras are equipped with automatic windshield glare reduction technology. The light sensor control optimizes contrast of occupants behind image of vehicle. Two photos are taken of each vehicle. Vehicle matching software is trained to recognize HMV's. Advanced facial detection software is optimized for real-time detection.

Images captured at roadside are processed for the locations of the occupants' faces. A confidence measure is generated for each area that seems to include a human face. If the confidence measure for a particular face is too low, that face is not counted. The confidence measure threshold can be adjusted to reduce false detection and other errors. Facial images with only one area of high enough confidence, and in a reasonable location relative to the vehicle, are taken to indicate a probable HOV violator. Images of suspected violators are JPEG compressed and forwarding for violation processing and validation.

Figure 2:
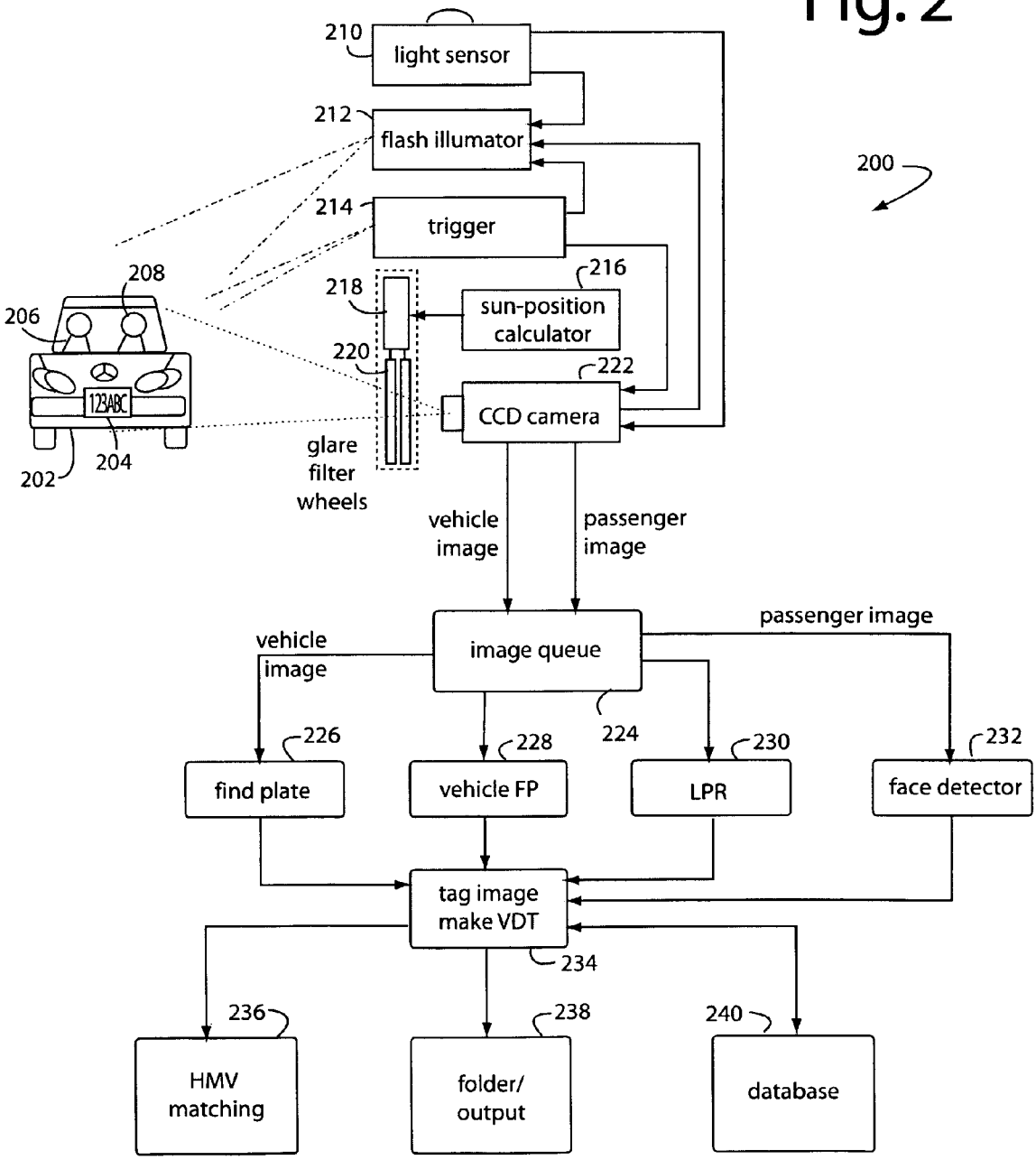
FIG. 2 is roadside enforcement unit embodiment of the present invention useful in the system of FIG. 1.

FIG. 2 shows a roadside enforcement unit embodiment of the present invention, and is referred to herein by the general reference numeral 200. The roadside enforcement unit 200 monitors traffic lanes for high occupancy vehicles (HOV), high mileage vehicles (HMV), and high occupancy toll (HOT) vehicles, such as a car 202 with a license plate 204 and occupants 206 and 208. The purpose of the monitoring of a lane is to make a preliminary determination if car 202 should be in the lane, or if its owner should be levied a fine or toll for having been in the lane. If it seems some enforcement or collection action should be taken, a video data tag (VDT) is packaged and forwarded for appropriate verification and action.

The roadside enforcement unit 200 is an advanced ITS network appliance that collects lane-violation information. It comprises a light sensor 210 that measures ambient lighting conditions, a flash illuminator 212, a trigger 214, a sun-position calculator 216, a filter-wheel activator 218, a set of polarizing filters 220, and a CCD camera 222. Such produces a vehicle image and a passenger image for an image queue 224 for every car 202 that passes by in the controlled lane. A find plate processor 226 locates the area of the vehicle image that includes the license plate 204. A vehicle fingerprint (FP) processor 228 identifies the type of car being imaged, e.g., a high mileage hybrid-electric Honda hybrid Civic, Toyota Prius, etc. HMV cars are allowed to use HOV lanes even with only one occupant. A license plate reading (LPR) processor 230 extracts the license plate number for indexing in a registration database. A face detector 232 identifies the areas that include a human face in the passenger image, and gauges their positions relative to the car. Faces appearing outside the passenger compartment area, e.g., are discarded as impossible. A tag image and VDT processor 234 packages up each vehicle record in a packet for storage and/or transmission. An HMV matching processor 236 consults the vehicle type recognized and the registration database to see if the car 202 appearing in the HOV lane should be disregarded as authorized. A folder 238 stores VDT packets for transmission and/or transportation. A useful transmission communication method includes the Internet and an Ethernet network adaptor. A database 240 provides registration and other vehicle information.

The light sensor 210 helps camera 222 adjust its 8-bit video grey-level dynamic range. For example, plate luminance levels can range from $f(10^0)$ to $f(10^9)$, so the sunny-day dynamic range is typically shuttered for $f(10^{4.5})$ to $f(10^{7.5})$, and the overcast dynamic range is shuttered for $f(10^1)$ to $f(10^2)$. The light sensor 210 also turns the flash illuminator 212 on/off.

The flash illuminator 212 is filtered to output light only outside the visible spectrum so as not to blind or otherwise distract the drivers being photographed. Typical car windshields are opaque to some IR and UV wavelengths, so the choice of flash spectrum can be very limited and must be chosen carefully to produce good results. The flash illuminator 212 typically comprises a long-life 4W xenon bulb good for over 4M flashes.

The trigger 214 can be a discrete laser range finding unit that can measure the distance from camera 222 to car 202. Or, camera 222 can simply be configured to take continuous images that are analyzed for valid content one-at-a-time.

Scattered light from the sun becomes polarized when reflected off of glass, water or even moisture particles in the atmosphere. A polarizer can filter out such unwanted light and reduce the adverse affects of reflected glare. The sun-position calculator 216 computes where the sun should be given the time, date, position, and orientation of camera 222. It activates motor 218 to rotate the polarized filter wheels 220 to best screen out sun glare from the vehicle and passenger images.

The face detector 232 can be implemented with the part of conventional face recognition software that isolates individual human faces in a video frame. E.g., FaceFINDER biometric identification software from Viisage (Billerica, Mass. 01821).

In general, an automated method of traffic lane use enforcement includes video-recording an image of a vehicle passing by in a controlled traffic lane. Then a license plate is recognized from the image. A vehicle type is determined from the image. A next step is the detecting, locating, and counting human faces from the image, and discarding any that are not in viable locations or do not have a high enough confidence measure. The license plate, vehicle type, and number of valid faces is analyzed for lane control violations or tolls, and packaging each set up in a VDT record. The VDT record is sent to a central processing center for inspection and issuing of lane control violations or tolls based on a human operator's assessment of each VDT record.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A traffic lane enforcement system, comprising:

a digital-camera providing for a vehicle image and a passenger image of a vehicle passing by in a controlled traffic lane;

an adaptive glare control filter with polarized lenses that can be positioned in front of the camera to reduce sun glare in said vehicle and passenger images;

a sun position calculator providing for a sun glare calculation and connected to control the adaptive-glare control filter;

an illumination subsystem providing for nighttime illumination of said vehicle;

a light sensor for controlling the illumination subsystem and exposure data to the camera according to ambient light conditions;

a vehicle image processor for analyzing said vehicle image to determine the vehicle's identity;

an occupant image processor for analyzing said passenger image to determine how many occupants there are in the vehicle; and a traffic lane enforcement controller for receiving information from the vehicle image processor and occupant image processor for determining there from if the vehicle's identity and number of passengers requires further enforcement action.

2. The system of claim 1, further comprising:

trigger device connected to control when the camera takes said vehicle and passenger images, and including a laser ranging subsystem.

3. The system of claim 1, further comprising:

an output device for communicating if the traffic lane enforcement controller determines that further enforcement action or billing is required, the output device including at least one of a network adaptor, wireless transceiver, or removable storage device to communicate file records based on said vehicle's identity and number of passengers detected.

4. The system of claim 1, further comprising:

a central processing center for receiving a video data tag (VDT) record from the traffic lane enforcement controller, and for issuing lane control violations or tolls based on a human operator's assessment of each received VDT record.

5. A roadside lane-violation enforcement unit, comprising:

a light sensor for measuring ambient lighting conditions;

a flash illuminator controlled by the light sensor and providing for non-visible spectrum illumination of vehicles passing by in a controlled traffic lane;

a sun-position calculator;

filter-wheel activator connected to a set of polarizing filters controlled by the sun-position calculator;

a digital camera for producing a vehicle image and a passenger image for a vehicle passing by and that have glare removed by said polarizing filters;

a find plate processor for locating an area of said vehicle image that includes a license plate;

a vehicle fingerprint (FP) processor for identifying a type of vehicle imaged by the camera;

a license plate reading (LPR) processor for extracting a license plate status from said vehicle image and then for indexing into a vehicle registration database;

a face detector for identifying areas that include a human face in said passenger image, and for gauging their positions relative to the vehicle;

a tag image and video data tag (VDT) processor for packaging up each vehicle record in a VDT packet for storage and/or transmission;

a high mileage vehicle (HMV) matching processor for consulting the vehicle type recognized and the vehicle registration database to see if a vehicle appearing in a controlled lane should be disregarded; and a folder for storing VDT packets for transmission to staff for verification and analysis.

6. An automated method of traffic lane use enforcement, comprising:

electronically triggering a video camera positioned for recording a video image of a vehicle passing by in a controlled traffic lane with lane enforcements for high occupancy vehicles;

recognizing a license plate from said video image with a find plate processor and a license plate reading processor;

determining a vehicle type from said video image with a vehicle fingerprint processor;

detecting, locating, and counting human faces from said video image with a face detector; and analyzing information derived by the find plate processor, license plate reading processor, vehicle fingerprint processor, and face detector regarding a license plate, vehicle type, and counted number of faces and packaging each set up in a video data tag (VDT) record with a tag image and VDT processor for later determining any high occupancy lane enforcement violations.

7. The method of claim 6, further comprising:

receiving said VDT record at a central processing center from a network transmission medium for VDT packets; and inspecting by staff at a review console and issuing of lane control violations or tolls based on a assessment of each VDT record a central processing center with a bill/fine issuer with an output for a bill-citation.

* * * * *